US011352112B2

(12) United States Patent
Romero Vázquez

(10) Patent No.: US 11,352,112 B2
(45) Date of Patent: Jun. 7, 2022

(54) ACCELERATING DUCTED PROPELLER SYSTEM FOR PROPELLING BOATS

(71) Applicant: Juan José Romero Vázquez, Aroche (ES)

(72) Inventor: Juan José Romero Vázquez, Aroche (ES)

( * ) Notice: Subject to any disclaimer, the term of this patent is extended or adjusted under 35 U.S.C. 154(b) by 71 days.

(21) Appl. No.: 16/955,590

(22) PCT Filed: Dec. 20, 2017

(86) PCT No.: PCT/ES2017/070834

§ 371 (c)(1),
(2) Date: Jun. 18, 2020

(87) PCT Pub. No.: WO2019/122464

PCT Pub. Date: Jun. 27, 2019

(65) Prior Publication Data

US 2020/0354033 A1 Nov. 12, 2020

(51) Int. Cl.
*B63H 5/15* (2006.01)
*B63H 5/125* (2006.01)
(Continued)

(52) U.S. Cl.
CPC ..... *B63H 5/15* (2013.01); *B63H 5/125* (2013.01); *B63H 5/16* (2013.01); *B63H 2011/081* (2013.01); *B63H 2023/005* (2013.01)

(58) Field of Classification Search
CPC ... B63H 5/00; B63H 5/07; B63H 5/08; B63H 5/125; B63H 2005/1254; B63H 5/14;
(Continued)

(56) References Cited

U.S. PATENT DOCUMENTS 2,030,375 A 2/1936 Kort
4,288,223 A 9/1981 Gonzalez et al.
(Continued)

FOREIGN PATENT DOCUMENTS

EP 2955099 A1 12/2015
ES 2460815 A1 5/2014
(Continued)

OTHER PUBLICATIONS

G. Kuiper, "The Wageningen Propeller Series", MARIN Maritime Research Institute Netherlands, First edition, 1992, pp. 51 and 53.
(Continued)

*Primary Examiner* — Daniel V Venne
(74) *Attorney, Agent, or Firm* — Cantor Colburn LLP

(57) ABSTRACT

An accelerating ducted propeller system for propelling boats offers enhanced performance, having the front end of the nozzle disposed at a radial distance (H) between 0.045D and 0.082D from the inner radius of the nozzle, where D is the inner diameter of the nozzle. The front end of the chord of the axial profile of the nozzle has a larger radius than the rear end of the chord with respect to the axis of rotation of the propeller. The inner surface of the nozzle at the axial distance (J) of 0.025D from the rear end of the output edge of the nozzle is at a radial distance from the inner radius of the nozzle of more than 0.0040D and less than 0.0300D. The radial difference between the inner radius of the nozzle and the outer radius of the profile of the nozzle is less than 0.092D.

39 Claims, 7 Drawing Sheets

(51) Int. Cl.
*B63H 5/16* (2006.01)
*B63H 11/08* (2006.01)
*B63H 23/00* (2006.01)

(58) Field of Classification Search
CPC . B63H 5/15; B63H 5/16; B63H 11/00; B63H 11/08; B63H 2011/081; B63H 2023/005
USPC ..... 440/66, 67
See application file for complete search history.

(56) References Cited

U.S. PATENT DOCUMENTS 5,292,088 A * 3/1994 Lemont ..... B63H 5/14 244/65
5,470,202 A * 11/1995 Lemont ..... B64C 11/001 415/211.1
5,651,707 A * 7/1997 Lemont ..... B64C 11/00 440/67
9,097,233 B1 8/2015 Ramsey

FOREIGN PATENT DOCUMENTS

GB 1318868 A 5/1973
WO 8911998 A1 12/1989
WO 2015101683 A1 7/2015

OTHER PUBLICATIONS

International Search Report dated Sep. 5, 2018 re: Application No. PCT/ES2017/070834, pp. 1-2, citing: WO 2015101683 A1, EP 2955099 A, GB 1318868 A and ES 2460815 A1.
W. Van Gent, et al., "Ducted Propeller Systems and Energy Saving in International Symposium on Ship Hydrodynamics and Energy Saving", El Pardo, Sep. 9, 1983.

* cited by examiner

ACCELERATING DUCTED PROPELLER SYSTEM FOR PROPELLING BOATS

TECHNICAL FIELD

The disclosure relates to an accelerating ducted propeller system for propelling boats, boat being used in the general sense of the term as a floating aquatic vessel, and may be used in the shipbuilding industry.

BACKGROUND

Technical concepts used:

Advance ratio $J=V_A/(nD_P)$. $V_A$ being the speed of advance of the thruster, n being the number of revolutions per second of the propeller and $D_P$ being the diameter of the propeller.

Propeller thrust coefficient $Ktp=Tp/(\rho n^2 D_P^4)$, Tp being the propeller thrust, and ρ being the water density.

Nozzle thrust coefficient $Ktn=Tn/(\rho n^2 D_P^4)$, Tn being the nozzle thrust.

Total thrust coefficient $Ktt=T/(\rho n^2 D_P^4)$, T being the total thrust of the propeller and the nozzle together.

Torque coefficient $Kq=Q/(\pi n^2 D_P^5)$, Q being the motor torque.

Ducted propeller isolated thruster output $\eta_0=J\ Ktt/(2\pi Kq)$.

Load index $C_T=8\ Ktt/\pi J^2$)

Condition of free sailing: when the boat sails exclusively with interior cargo; in this condition the load index Ct normally has a value comprised between 4 and 0.2.

Condition of trawling or towing: when a boat is trawling a fishing net or towing another boat; in this case the speed of the boat is slow in relation to the thrust of the ducted propeller system, the load index Ct has a high value, greater than the value of 4 Ct, normally from 15 to 26 Ct; only fishing trawlers or tugboats sail in this condition when they are carrying out these specific tasks.

Condition of pulling from a fixed point: when a tugboat pulls an object that does not move at maximum power, for example a bollard at a port, in which case the thrust is maximum and the speed of advance is zero. Tugboats only use this condition until the boat they are towing with a cable generally begins to move, which happens in a short time, then moving on to a towing condition. The efficiency in this case is $\eta_d=(Ktt/\pi)^{3/2}/Kq$, the merit coefficient.

Some coefficients with factor D or L are used to indicate certain distances based on the inner diameter of the nozzle on the propeller plane D or the axial length of the nozzle L, the inner radius of the nozzle in this document being half the aforementioned diameter D, in other words, that which is measured on the propeller plane, since there are nozzles in which the inner diameter on the output edge is smaller than the inner diameter on the propeller plane, such as decelerating nozzles; as is obvious, this must be specified so as to avoid confusion.

L/D ratio: axial length of the nozzle divided by the inner diameter of the nozzle on the propeller plane.

Sternpost: continuation of the boat's keel at the stern.

To refer to the different coaxial cross sections of the axis of rotation of the propeller blades, the propeller radius R is used as a reference, thus the coaxial cross section 0.90R refers to the coaxial cross section of the blade at the distance 0.90R of the axis of rotation of the propeller; the coaxial cross section 1.00R is at the tip of the blade. Kaplan-type blades are used in the nozzle, which are fixed pitch propellers (FPP), whose coaxial cross section 1.00R at the blade tip is arched and equidistant along the entire coaxial length thereof from the cylindrical inner walls of the nozzle; and controllable-pitch propellers (CPP) are also used in the nozzle.

Mean camber line, also called mean line, is the line defined by the midpoints between the surfaces of both sides of an aerodynamic or hydrodynamic profile, the ends of the mean camber line coinciding for practical purposes at the input and output edges of the profile.

Chord line: the line that joins the ends of the mean line.

Chord: on both a profile of a wing and a profile of a nozzle, it is the segment of the straight line that joins the ends of the mean camber line, the real cross sections of both the wing and the nozzle being flat, and the chord naturally forms part of a straight line, the distance between both ends of the mean line being called the chord length.

Propeller plane: according to the definition established by the International Towing Tank Conference ITTC, it refers to the plane perpendicular to the axis of rotation of the propeller that contains the propeller reference line.

Pitch: the theoretical distance a propeller advances with each complete revolution if the pitch distribution is even for all coaxial cross sections from the root to the tip. In general, the typical pitch of a marine propeller exclusively has coaxial cross section 0.7R when the pitch distribution is uneven, which is the case almost all of the time.

Ae/Ao area ratio: Ae refers to the total surface of the blades and Ao refers to the area of the swept disc.

Azimuth or directional thruster: azimuth propelling system in which the ducted propeller assembly can rotate 360° on as substantially vertical axis, thereby making a rudder unnecessary. Water always flows in only one direction inside the nozzle.

Open propeller: a propelling system that has a propeller without a nozzle.

As has been known since the 1930s, an accelerating ducted propeller system for propelling merchant ships, tugboats and fishing trawlers comprises a propeller and a nozzle which is a tube-shaped duct, open at both sides; according to the general direction of the water flow while the boat is moving forward, the nozzle first has a convergent surface on the inside from the input edge to the output edge and then a surface that surrounds the propeller, and lastly, downstream from the propeller, a surface reaching the output edge and, naturally, an outer surface from the input edge to the output edge; the profile of the nozzle corresponds to a cross section of the nozzle by a plane that contains the axis of rotation of the propeller; the propeller rotates inside the nozzle joined to a drive shaft; said drive shaft passes through a support; in the classic configuration, said support is joined to the sternpost at the stern of the boat and the nozzle is joined to the stern of the boat by means of rigid supports when a single propeller and a single nozzle are used, when a ducted propeller assembly is used, on each side of the keel, the supports of the propeller shaft are buttresses and the nozzles are also joined to the hull by supports; and in the azimuth or directional propelling configuration, the ducted propeller assembly, as well as the support of the propeller shaft, which is joined in a nearby fashion to the propeller, integrally rotate 360° on a substantially vertical axis and the water always flows in a single direction inside the nozzle, both in a forwards and in a backwards direction.

It is clear that both in the classic propelling configuration and in the directional or azimuth configuration, the nozzle is fixed with respect to a vertical plane that contains the axis of rotation of the propeller, as a common reference.

Nozzles that are rigidly joined to the propeller blade tips, rotating with them, known as ring propellers, have been tested, but the output is less than that of fixed nozzles that naturally do not rotate, separated by a small space (clearance of less than 0.5% of the inner diameter D of the nozzle) from the propeller blade tips.

In the majority of current nozzles, the inner surface that surrounds the propeller is cylindrical, and downstream from the propeller the inner surface is usually divergent in fixed nozzles, and in directional nozzles it is usually cylindrical; and the outer surface is usually conical with a greater radius on the front part, the input edge is usually rounded and the output edge is also usually rounded; in front of the propeller, the convergent inner surface is always present in any nozzle for fishing boats and transport vessels and is normally convex.

The operation of ducted propeller systems currently built basically consists of mutual interaction, the suction of the propeller produces a depression on the front convergent inner surface of the nozzle and this pressure difference compared to that of the rest of the walls of the nozzle creates a thrust force, the axial component of which thrusts the nozzle forwards; this thrust is added to that of the propeller.

Currently, for propelling boats that are operating in a condition of free sailing, trawling or towing, the 19A nozzle is most commonly used, developed several decades ago by the Maritime Research Institute Netherlands MARIN, which has been the most popular standard reference for the world for many decades in the development of propellers and nozzles; the axial length of the profile of the nozzle is 0.50D (pages 51 and 53 of the following book, Title: "The Wageningen Propeller Series", ISBN: 90-900 7247-0, Author G. Kuiper, Edited by: MARIN Maritime Research Institute Netherlands, First edition, Edited in: The Netherlands, Year of publication, 1992); the front end of the input edge of the nozzle is at a radial distance from the inner radius of the nozzle (on the propeller plane) of 0.091D according to the published coordinates of said profile; the radial difference between the inner radius and outer radius of the nozzle is 0.105D or 0.210L; according to the general direction of the water flow while the boat is moving forward, the front end of the chord of the profile of the nozzle has a greater radius than the rear end of said chord; and the propeller plane is at an axial distance of 0.50L from the front end of the input edge of the nozzle which, given that L/D=0.5, corresponds to a distance of 0.25D in fixed pitch propellers (FPP), Kaplan-type propellers with a pointed-type profile, the axial rake of the blades with a value of zero and circumferential skew of the blades with a value of zero, when controllable-pitch propellers (CPP) are used the distance being approximately the same 0.25D; the outer surface of the 19A nozzle being conical with a greater radius in the front area.

Other parameters of the 19A ducted propeller system are indicated in the description of FIG. 7.

More recently, the 19B nozzle, also developed by MARIN, is very similar in shape to the 19A nozzle, although with some subtle changes that increase output in all values of the advance ratio J in a noticeable way. The aforementioned parameters for the 19A nozzle are the same for the 19B nozzle.

Fishing trawlers sail both in a condition of free sailing to fishing zones, as well as in a trawling condition for fishing, specifically by dragging a net, and for that reason many use the 19A nozzle; in a trawling or dragging condition the advance ratio J is very low and the total thrust coefficient Ktt is very high, and the torque coefficient Kq is also very high.

The coordinates of the 19A profile are published in books and many documents, such as the document cited as D01 (FIG. 10, page 9) in document ES2460815 dated Feb. 1, 2014 "VAN GENT, W. and OOSTERVELD, M. V. C.: Ducted Propeller Systems and Energy Saving in International Symposium on Ship Hydrodynamics and Energy Saving, El Pardo, 9 Sep. 1983".

It is in the trawling or towing condition of the boat when the ducted propeller systems that are currently used provide the greatest output with respect to open propeller systems, and the difference is large. In a condition of free sailing, current ducted propeller systems only provide more output with respect to open propellers for moderate load indices 4-2 $C_T$ and the difference is small.

Currently, boats that sail with a small load index, normally below the value 2 CT do not use nozzles, but rather an open propeller.

Decelerating nozzles have a different geometry, with a smaller convergent inner surface upstream from the propeller and generally have a convergent inner surface downstream from the propeller, and therefore the inner diameter of the nozzle on the output edge can be smaller than the inner diameter of the nozzle on the propeller plane; the output is greatly reduced when compared to accelerating nozzles; they are only used to prevent noise from the propeller in the water in very specific applications for which this quality is required.

Other reference documents:

U.S. Pat. No. 2,030,375 issued on Nov. 2, 1936, FIGS. 8 and 15: the propeller is very close to the output edge of the nozzle.

WO8911998 published on 14/12/1989, titled "DOUBLE NOZZLE", does not make any written mention in the abstract, description or claims to the dimensions of the nozzle, nor does it mention whether the figures are drawn to scale or not, and thus it must be assumed that the dimensions of the isolated elements, represented in the figure, are random and therefore not representative.

In U.S. Pat. No. 9,097,233 issued on Apr. 8, 2015, FIGS. 2 and 3 show that the turbine is very close to the output edge of the duct.

U.S. Pat. No. 4,288,223 issued on Aug. 9, 1981, FIG. 4.

In claim 12 of ES2460815 B2 published on 14/05/2014, and in claim 14 of WO2015101683 A1 published on Sep. 7, 2015, by the same applicant of the present application, it is indicated that the inner surface of the nozzle downstream from the propeller is divergent, but no specific value is given, and neither a range of maximum and minimum values nor the total axial length of said divergence is specified; furthermore, neither the continuity nor discontinuity nor the shape of said divergent surface is specified.

In the preferred embodiment, the axial position of the centre of the blade tips with respect to the nozzle is specified, but only for the cylindrical inner surface of the nozzle downstream from the propeller, not for the divergent surface.

Other distinguishing parameters are indicated in the description of FIG. 8.

In the year 2014, tests that were done with an isolated propeller in still water channels based on ES2460815 B2 and WO2015101683 A1, focusing on their application in fishing trawlers, showed that in the condition of free sailing from the port to the fishing ground and vice versa, the output was greater than that of the same propeller with the 19B nozzle, and in a trawling condition it was around 5% less than that of the same propeller with the 19B nozzle.

The present disclosure is, in part, aimed at maintaining the same output increase in the condition of free sailing, and increasing the output in the trawling or towing condition until equalling or surpassing that of the same propeller with the 19A or 19B nozzle.

There are directional ducted propeller systems currently in use in which the blades are very close to the output edge of the nozzle, practically on the output edge, the inner surface of the nozzle near the output edge being cylindrical.

In ES2385994 B2 published on Jun. 8, 2012 and WO2013178837 published on May 12, 2013 by the same applicant of the present application, an important feature is that the chord of the profile of the nozzle is closer to the axis of rotation of the propeller at the front end of the profile than at the rear end.

It is a nozzle with a divergent surface downstream from the propeller. The output is less in a trawling condition, compared to the same propeller in a 19A nozzle, according to a test carried out.

The current technical problem is the low output of the ducted propeller systems in a condition of free sailing and also in towing or trawling conditions because it is desirable to increase output to save fuel.

The effort to achieve greater output in ducted propeller systems has been consistent over the years by researchers and research teams of both companies and universities, especially since the oil crisis of 1973 up to the present, in all market sectors.

The aim of the present disclosure is to increase the output of the ducted propeller system, both in a trawling or towing condition at a low speed, and in a condition of free sailing at any speed.

SUMMARY

The previously mentioned technical problem of low output of the current ducted propeller systems is solved by the use of a new accelerating ducted propeller system for propelling boats (floating aquatic vessels), the propeller being configured to rotate inside the nozzle, according to the disclosure, the nozzle is fixed with respect to a vertical plane that contains the axis of rotation of the propeller; according to the general direction of the water flow while the boat is moving forward, the front end of the input edge of the nozzle is at a radial distance from the inner radius of the nozzle comprised between 0.045D and 0.082D, where D is the inner diameter of the nozzle on the propeller plane and considering the inner radius of the nozzle from the axis of rotation of the propeller to the inner surface of the nozzle on the propeller plane; according to the general direction of the water flow while the boat is moving forward, the front end of the chord of the axial profile of the nozzle has a greater radius than the rear end of said chord, with respect to the axis of rotation of the propeller; considering the general direction of the water flow while the boat is moving forward, the inner surface of the nozzle at the axial distance of 0.025D from the rear end of the output edge of the nozzle is at a radial distance from the inner radius of the nozzle that is greater than 0.0040D and less than 0.0300D, considering the inner radius of the nozzle from the axis of rotation of the propeller to the inner surface of the nozzle on the propeller plane; and on a plane that contains the axis of rotation of the propeller, the radial difference between the inner radius of the profile of the nozzle and the outer radius of the profile of the nozzle is less than 0.092D (the combination of all of the features creates a different behaviour; in fluid mechanics, specific subtle changes lead to highly significant behavioural changes).

Preferably, the front end of the input edge of the nozzle is at a radial distance from the inner radius of the nozzle comprised between 0.045D and 0.080D; the inner surface of the nozzle at the axial distance of 0.025D from the rear end of the output edge of the nozzle is at a radial distance from the inner radius of the nozzle greater than 0.0060D and less than 0.0250D; and the radial distance between the inner radius of the profile of the nozzle and the outer radius of the profile of the nozzle is less than 0.090D.

More preferably, the front end of the input edge of the nozzle is at a radial distance from the inner radius of the nozzle comprised between 0.045D and 0.075D; the inner surface of the nozzle at the axial distance of 0.025D from the rear end of the output edge of the nozzle is at a radial distance from the inner radius of the nozzle that is greater than 0.0080D and less than 0.0200D; and the radial distance between the inner radius of the profile of the nozzle and the outer radius of the profile of the nozzle is less than 0.088D.

Even more preferably, the front end of the input edge of the nozzle is at a radial distance from the inner radius of the nozzle comprised between 0.045D and 0.070D; the inner surface of the nozzle at the axial distance of 0.025D from the rear end of the output edge of the nozzle is at a radial distance from the inner radius of the nozzle that is greater than 0.0100D and less than 0.0175D; and the radial distance between the inner radius of the profile of the nozzle and the outer radius of the profile of the nozzle is less than 0.086D.

Most preferred, the front end of the input edge of the nozzle is at a radial distance from the inner radius of the nozzle comprised between 0.050D and 0.065D; the inner surface of the nozzle at the axial distance of 0.025D from the rear end of the output edge of the nozzle is at a radial distance from the inner radius of the nozzle that is greater than 0.0130D and less than 0.0150D; and the radial distance between the inner radius of the profile of the nozzle and the outer radius of the profile of the nozzle is less than 0.082D.

In a preferred embodiment of the disclosure, the radial difference between the centre of the chord of the profile of the nozzle and the outer radius of the profile of the nozzle on the same plane perpendicular to the axis of rotation of the propeller that contains the centre of the chord is less than 0.052L, L being the axial length of the nozzle.

Preferably, according to the previous embodiment, the radial difference between the centre of the chord of the profile of the nozzle and the outer radius of the profile of the nozzle on the same plane perpendicular to the axis of rotation of the propeller that contains the centre of the chord is less than 0.040L, L being the axial length of the nozzle.

More preferably, the radial difference between the centre of the chord of the profile of the nozzle and the outer radius of the profile of the nozzle on the same plane perpendicular to the axis of rotation of the propeller that contains the centre of the chord is less than 0.030L, L being the axial length of the nozzle.

In another embodiment, the nozzle of the system is formed by a single ring-shaped profile.

In another embodiment, the propeller has a periphery with the greatest radius of each blade, coaxial to the axis of rotation of the propeller, with a length greater than 0.20R for said coaxial periphery, R being the radius of the blades.

In another embodiment, on a plane that contains the axis of rotation of the propeller and according to the general direction of the water flow while the boat is moving forward, the radial distance between the inner surface of the nozzle and the outer surface of the nozzle is greater than 0.043D, at an axial distance of 0.066285D downstream from the front end of the input edge of the nozzle; considering the general direction of the water flow while the boat is moving forward and on a plane that contains the axis of rotation of the propeller, the inner line of the axial profile of the nozzle, at the convergent area, upstream from the propeller, is convex toward the axis of rotation of the propeller in more than 25% of the axial length thereof; and the propeller plane is at a distance greater than 0.38L and less than 0.70L from the front end of the input edge of the nozzle.

Preferably, and according to the previous embodiment, the radial distance between the inner surface of the nozzle and the outer surface of the nozzle is greater than 0.044D, at an axial distance of 0.066285D downstream from the front end of the input edge of the nozzle; the inner line of the axial profile of the nozzle, at the convergent area, upstream from the propeller, is convex towards the axis of rotation of the propeller in more than 30% of the axial length thereof; and the propeller plane is at a distance greater than 0.40L and less than 0.65L from the front end of the input edge of the nozzle.

More preferably, the radial distance between the inner surface of the nozzle and the outer surface of the nozzle is greater than 0.045D, at an axial distance of 0.066285D downstream from the front end of the input edge of the nozzle; the inner line of the axial profile of the nozzle, at the convergent area, upstream from the propeller, is convex towards the axis of rotation of the propeller in more than 60% of the axial length thereof; and the propeller plane is at a distance greater than 0.42L and less than 0.60L from the front end of the input edge of the nozzle.

Even more preferably, the radial distance between the inner surface of the nozzle and the outer surface of the nozzle is greater than 0.048D, at an axial distance of 0.066285D downstream from the front end of the input edge of the nozzle; the inner line of the axial profile of the nozzle, at the convergent area, upstream from the propeller, is convex towards the axis of rotation of the propeller in more than 99% of the axial length thereof; and the propeller plane is at a distance greater than 0.44L and less than 0.55L from the front end of the input edge of the nozzle Most preferred, the radial distance between the inner surface of the nozzle and the outer surface of the nozzle is greater than 0.051D, at an axial distance of 0.066285D downstream from the front end of the input edge of the nozzle; the inner line of the axial profile of the nozzle, at the convergent area, upstream from the propeller, is convex towards the axis of rotation of the propeller in 100% of the axial length thereof; and the propeller plane is at a distance greater than 0.45L and less than 0.52L from the front end of the input edge of the nozzle.

In another embodiment, considering the general direction of the water flow while the boat is moving forward, more than 80% of the inner surface of the nozzle downstream from the propeller to the output edge is continuously divergent.

Preferably, according to the preceding embodiment, the inner surface of the nozzle downstream from the propeller is conical.

In another embodiment, on a plane that contains the axis of rotation of the propeller, the radial difference between the inner radius of the profile of the nozzle and the outer radius of the profile of the nozzle is less than 0.184L.

Preferably, according to the preceding embodiment, the radial difference between the inner radius of the profile of the nozzle and the outer radius of the profile of the nozzle is less than 0.176L.

More preferably, the radial difference between the inner radius of the profile of the nozzle and the outer radius of the profile of the nozzle is less than 0.170L.

Even more preferably, the radial difference between the inner radius of the profile of the nozzle and the outer radius of the profile of the nozzle is less than 0.148L.

Most preferred, the radial difference between the inner radius of the profile of the nozzle and the outer radius of the profile of the nozzle is less than 0.144L.

In another embodiment, considering the general direction of the water flow while the boat is moving forward, the outer surface of the nozzle, on the margin of the input edge and output edge, has a lower inclination with respect to the axis of rotation of the propeller on the part next to the input edge than on the rest to the output edge.

Preferably, according to the preceding embodiment, the outer surface of the nozzle, on the margin of the input edge and output edge, is substantially cylindrical on the front part next to the input edge, with an axial length greater than 0.038L and less than 0.25L.

More preferably, the outer surface of the nozzle, downstream from the substantially cylindrical surface, is substantially conical to the output edge.

In another embodiment, according to the general direction of the water flow while the boat is moving forward, the output edge of the nozzle is substantially blunt.

Preferably, according to the preceding embodiment, the output edge has a substantially toroidal-shaped surface and the radius of curvature of said surface is less than 0.012D.

In another embodiment, considering the general direction of the water flow while the boat is moving forward, the convergent inner surface of the front part of the nozzle is joined to the outer surface of the nozzle by a toroidal-shaped surface, forming the input edge for water in the nozzle; and all or part of the inner surface of the nozzle that surrounds the propeller is cylindrical with the smallest inner radius of the nozzle.

In another embodiment, the coordinates of the profile of the nozzle are the following: the value of the abscissae is established at 100X/L, taking the values of X from the input edge; 100Yi/L for the value of the inner ordinates; and 100Yu/L for the value of the outer ordinates.

| 100X/L | 100 Yi/L | 100YU/L |
|---|---|---|
| 0.000 | 10.950 | 10.950 |
| 2.083 | 7.605 | 13.033 |
| 5.807 | 5.377 | 13.033 |
| 9.532 | 3.900 | 13.033 |
| 13.257 | 2.800 | 13.033 |
| 16.981 | 1.977 | 12.900 |
| 20.706 | 1.300 | straight line |
| 24.431 | 0.763 | " |
| 28.155 | 0.370 | " |
| 31.880 | 0.111 | " |
| 36.874 | 0.000 | " |
| 50.000 | 0.000 | " |
| 60.000 | 0.000 | " |
| 70.000 | straight line | " |
| 80.000 | " | " |
| 90.000 | " | " |
| 99.074 | 3.000 | 4.869 |
| 100.000 | 3.926 | 3.926 |

the centre of rotation of the radius of the circumference that creates the toroidal surface of the input edge is established on the abscissa 100X/L=2.083 and ordinate 100Y/L=10.950; the length of the radius has the same value as the abscissa;

the centre of rotation of the radius of the circumference that creates the toroidal surface of the output edge is established on the abscissa 100X/L=99.074 and ordinate 100Y/L=3.926; and the axial length of the nozzle is 0.50D and thus L/D=0.5

In another embodiment, considering the general direction of the water flow while the boat is moving forward, the front end of the input edge of the nozzle is at a radial distance from the inner radius of the nozzle comprised between 0.055D and 0.080D.

Preferably, according to the preceding embodiment, the front end of the input edge of the nozzle is at a radial distance from the inner radius of the nozzle comprised between 0.057D and 0.080D.

More preferably, the front end of the input edge of the nozzle is at a radial distance comprised from the inner radius of the nozzle between 0.060D and 0.075D.

Even more preferably, the front end of the input edge of the nozzle is at a radial distance from the inner radius of the nozzle comprised between 0.065D and 0.075D.

In another embodiment, the coordinates of the profile of the nozzle are the following:

the value of the abscissae is established at 100X/L, taking the values of X from the input edge; 100Yi/L for the value of the inner ordinates; and 100Yu/L for the value of the outer ordinates.

| 100X/L | 100 Yi/L | 100YU/L |
|---|---|---|
| 0.000 | 14.000 | 14.000 |
| 2.269 | — | 16.269 |
| 4.214 | 8.006 | 16.269 |
| 10.697 | 4.214 | 16.269 |
| 13.197 | — | 16.114 |
| 17.018 | 1.900 | straight line |
| 25.000 | 0.500 | " |
| 36.791 | 0.000 | " |
| 40.000 | 0.000 | " |
| 50.000 | 0.000 | " |
| 56.791 | 0.000 | " |
| 60.000 | straight line | " |
| 70.000 | " | " |
| 80.000 | " | " |
| 90.000 | " | " |
| 99.074 | 3.000 | 4.869 |
| 100.000 | 3.926 | 3.926 |

the centre of rotation of the radius of the circumference that creates the toroidal surface of the input edge is established on the abscissa 100X/L=2.269 and ordinate 100Y/L=14.000; the length of the radius has the same value as the abscissa;

the centre of rotation of the radius of the circumference that creates the toroidal surface of the output edge is established on the abscissa 100X/L=99.074 and ordinate 100Y/L=3.926; and the axial length of the nozzle is 0.50D.

In another embodiment, the nozzle is fixed with respect to the hull of the boat (the nozzle functioning with the water flowing in one direction when the boat is moving forward and the water flowing in the opposite direction when the boat is moving backwards, with respect to the nozzle).

In another embodiment, the nozzle forms part of a directional thruster, also called azimuth thruster (the nozzle functioning with water always flowing in the same direction with respect to the nozzle, when the boat is moving forward and when it is moving backwards).

The ducted propeller system for propelling boats forms part of a boat with a motor that is joined to it and provides rotational movement to the propeller shaft.

This ducted propeller system proposed has the advantage of increasing output, and therefore reducing fuel consumption by the same proportion for boats in a trawling or towing condition moving at slow speeds and in a condition of free sailing at any speed.

The disclosure also relates to a boat, which comprises at least a motor joined to a shaft to provide rotational movement to a ducted propeller, as has been previously defined.

In an embodiment of this other aspect of the disclosure, the boat has from two to ten ducted propeller systems.

BRIEF DESCRIPTION OF THE DRAWINGS

To complement the description provided herein, and for the purpose of helping to make the features of the disclosure more readily understandable, said description is accompanied by a set of drawings constituting an integral part of the same, which by way of illustration and not limitation represents the following.

DETAILED DESCRIPTION OF THE DRAWINGS

Figure 1:
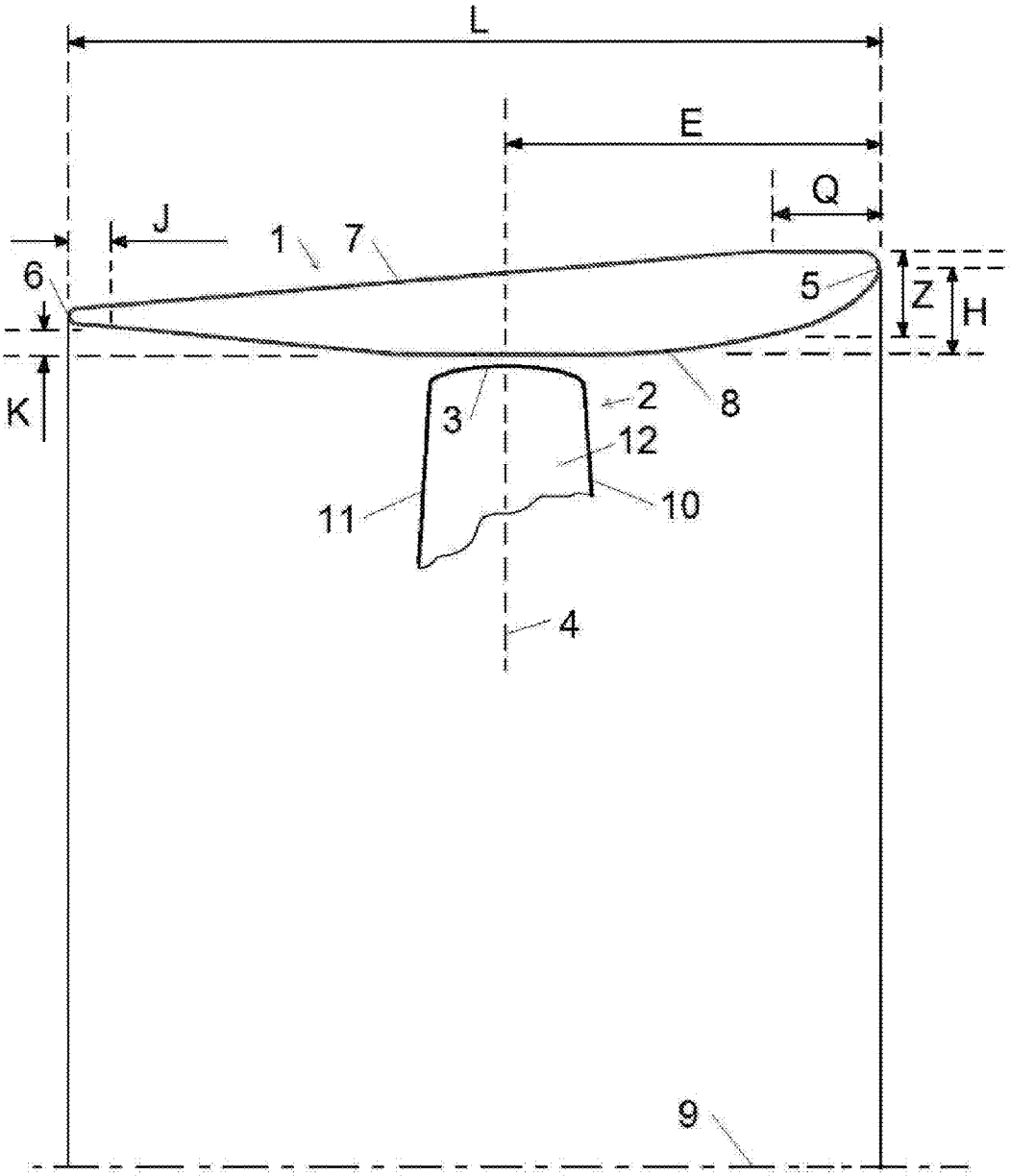
FIG. 1 is a schematic profile representation of an accelerating nozzle fixed with respect to the hull of a boat, on a plane that contains the axis of rotation of the propeller and which corresponds to the first previously indicated coordinates for the profile of the nozzle; and part of the propeller blade is also represented.

FIG. 1 shows the nozzle 1 fixed with respect to the hull of the boat; a propeller blade 2 with its input edge 10 and its output edge 11, with its pressure face 12; the dashed line 4 which represents the propeller plane perpendicular to the axis of rotation 9 of the propeller; the blade tip 3 in this case being coaxial to the axis of rotation of the propeller and to the inner walls of the nozzle, section 1.00R of the blades; the blades not having an axial rake nor a circumferential skew; and it also shows the front end 5 of the input edge of the nozzle when the boat is moving forward; the rear end 6 of the output edge of the nozzle when the boat is moving forward; the outer surface 7 of the nozzle; the inner surface 8 of the nozzle; the axial distance E from the propeller plane 4 to the front end 5 of the input edge of the nozzle, which in this embodiment equals 0.2299D, D being the inner diameter of the nozzle, this value 0.2299D being illustrative and non-limiting, expressed as a function of L equals 0.4598L; the axial distance Q from the front end 5 of the input edge of the nozzle to an axial distance downstream of 0.066285D; the radial distance Z with a value of 0.051D, between the inner surface of the nozzle and the outer surface of the nozzle, to the aforementioned axial distance Q; the axial length L of the nozzle which equals 0.50D; the radial distance H from the front end 5 of the input edge of the nozzle to the inner radius of the nozzle, which in this embodiment equals 0.055D; the total axial length of the divergence of the inner walls of the nozzle continuously equal 0.40L; all according to the aforementioned first coordinates and with the value of the axial length L of the nozzle equal to 0.50D, on which this embodiment is based. It can be seen how the inner walls 8 in the convergent area are convex according to the direction of the flow in the front part of the nozzle, the surface of the part that surrounds the blade tips later becoming cylindrical, and later divergent with a conical surface to the output edge 6; in this figure it can be seen how the outer surface 7 of the profile keeps its radius downstream from the input edge to the abscissa 100X/L=13.257 with a cylindrical surface, the radius thereof then becoming smaller until the output edge of the nozzle with a conical surface.

The blade tips are covered by the cylindrical inner surface of the nozzle.

The axis of rotation 9 of the propeller that in this case coincides with the axis of symmetry of the nozzle can also be seen.

The inner surface of the nozzle at the axial distance J of 0.025D from the rear end 6 of the output edge of the nozzle is at a radial distance K of 0.0134D from the inner radius of the nozzle The radial difference between the inner radius of the profile of the nozzle and the outer radius of the profile of the nozzle is 0.130L The clearance between the blade tips of the propeller and the nozzle is in practice less than 0.5% of the inner diameter of the nozzle.

Figure 2:
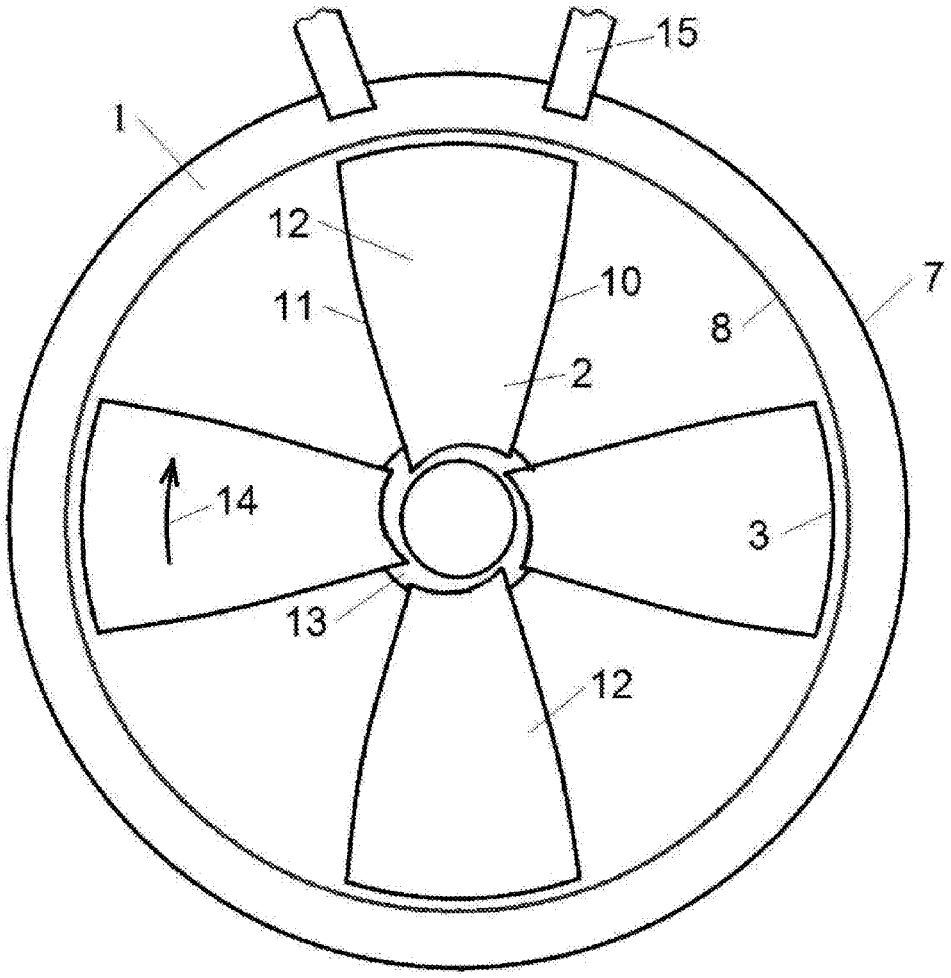
FIG. 2 is a schematic representation of the fixed pitch propeller assembly, nozzle and nozzle supports, viewed from downstream, while the boat is moving forward.

FIG. 2 shows the fixed pitch propeller with four blades 2, the blade tips 3 arched and equidistant from the cylindrical inner surface 8 of the nozzle, the direction of rotation of the blades indicated by the arrow 14, the core 13 of the propeller, and the supports 15 of the nozzle 1 that fix the nozzle to the stern of the boat, not shown in this figure; the input edge 10 of the blade, the output edge 11 of the blade, the outer surface 7 of the nozzle; and the inner surface 8 of the nozzle. In this figure the four blades all show the pressure face 12, since it is a view from downstream.

Figure 3:
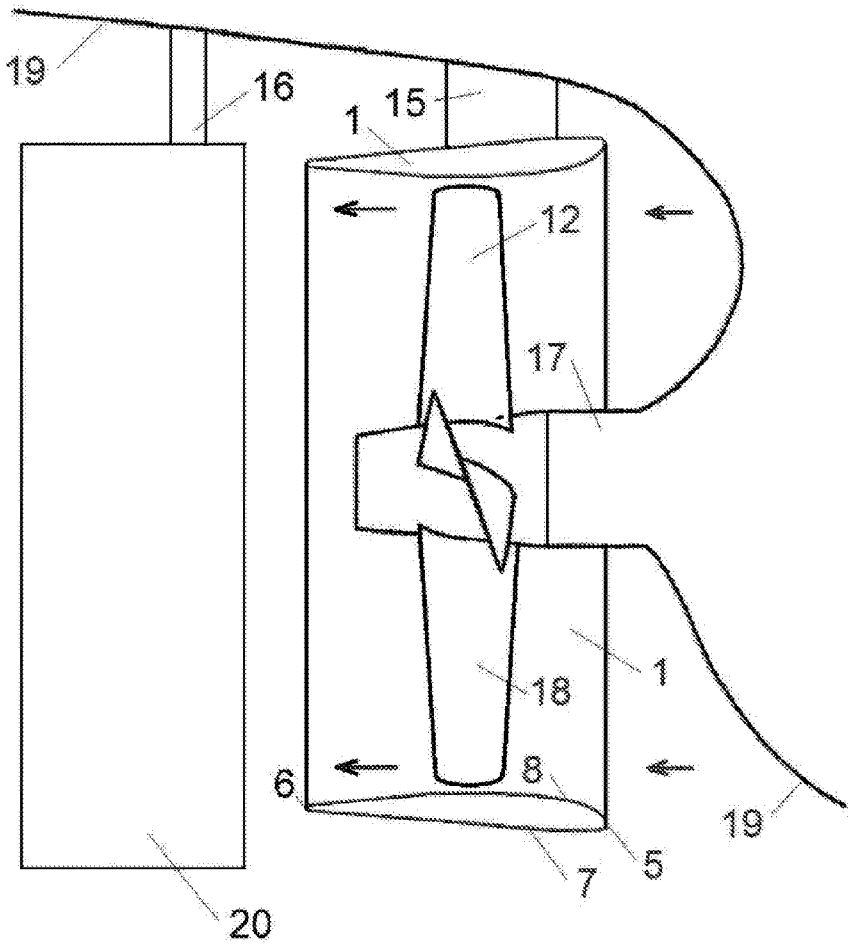
FIG. 3 is a schematic representation of the accelerating ducted propeller system, the nozzle shown vertically cut by a plane that contains the axis of rotation of the nozzle; the figure represents the propeller with blades and core (cube), the rear support of the propeller shaft, the sternpost, a support for the nozzle and the rudder; forming part of a boat, so that the details of the assembly can be clearly seen.

FIG. 3 shows the nozzle 1 vertically cut (all nozzles are hollow, not solid); and the propeller with its blades in this view; the upper blade showing the pressure face 12 thereof, the lower blade showing the suction face 18 thereof, since the propeller rotates clockwise when seen from downstream; the rudder 20 and its post 16, one of the two supports 15 of the nozzle and the sternpost 19 that forms part of the boat. The propeller core (central part of the propeller) is joined to the shaft and the shaft to the motor of the boat. The drive shaft passes inside a support 17 in the stern of the hull. It also indicates the general direction of the water with four arrows, the outer surface 7 of the nozzle, the inner surface 8 of the nozzle, the front end 5 of the input edge of the nozzle and the rear end 6 of the output edge of the nozzle. According to the ducted propeller system, when the propeller rotates it creates less static pressure in front of the nozzle, creating a depression in the convergent inner surface, the pressure difference with the rest of the walls creates an axial component that thrusts the nozzle forward and therefore the boat by means of the supports that join the nozzle to the stern of the boat. Both the propeller and the nozzle thrust the boat. The ducted propeller system forms part of the boat.

Figure 4:
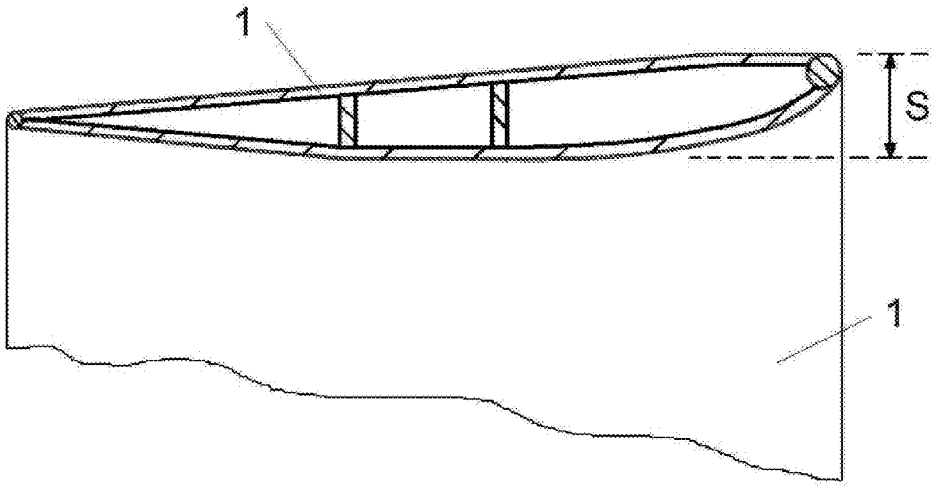
FIG. 4 is a profile representation of the profile of the nozzle shown vertically cut by a plane that contains the axis of rotation of the propeller, with a suitable inner structural distribution to make the material rigid and light and to use less material. The nozzle profile used in all of FIGS. 1 to 4 is defined by the first coordinates.

FIG. 4 shows the profile of the nozzle proposed 1, with the radial difference S between the inner radius of the profile of the nozzle and the outer radius of the profile of the nozzle that equals 0.130L; said nozzle shown cut by a plane that contains the axis of rotation of the propeller, with an inner structural distribution that is suitable to make it light and resistant and to use less material; the input edge of the nozzle and the output edge are made up of two substantially metal toric pieces, joined to metal plates that follow the profile of the indicated nozzle both on the outside and on the inside; between the metal plates that make up the outer and inner surface of the nozzle, two metal rings are arranged that join both the inner and outer sides of the profile of the nozzle so as to provide structural rigidity to the assembly.

Figure 5:
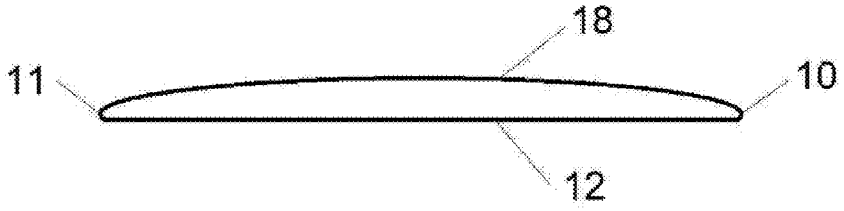
FIG. 5 is a representation of a profile of a pointed-type blade.

FIG. 5 shows a pointed profile on the side of the pressure face 12, the side of the suction face 18, and the input edge 10 and the output edge 11, relatively sharpened.

Figure 6:
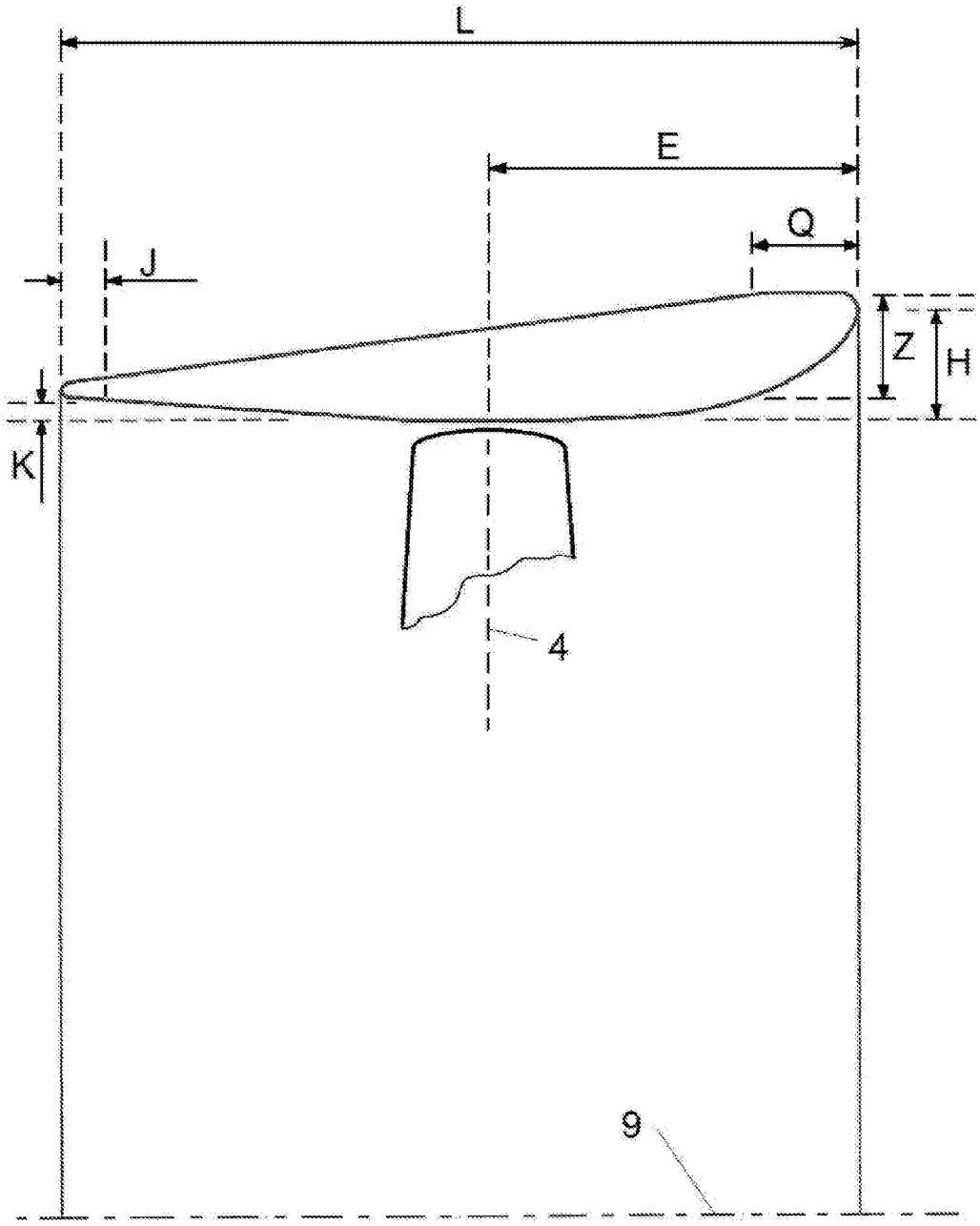
FIG. 6 is a schematic representation of the nozzle profile of the second coordinates, as an alternative embodiment.

FIG. 6 shows a ducted propeller system, wherein the profile of the nozzle is defined by the previously mentioned second coordinates, as an alternative embodiment for applications where the boat sails mainly with high load indices. Everything is the same as FIG. 1, except the inner surface of the nozzle at the axial distance J of 0.025D from the rear end of the output edge of the nozzle, which is at a radial distance K of 0.0135D from the inner radius of the nozzle; the axial distance E that equals 0.2344D and is illustrative and non-limiting, expressed as a function of L is 0.4689L; the radial distance H between the front end of the input edge and the inner radius of the nozzle which equals 0.070D; the radial distance Z which equals approximately 0.058D; and the radial distance between the inner radius of the profile of the nozzle and the outer radius of the profile of the nozzle which equals 0.163L.

Figure 7:
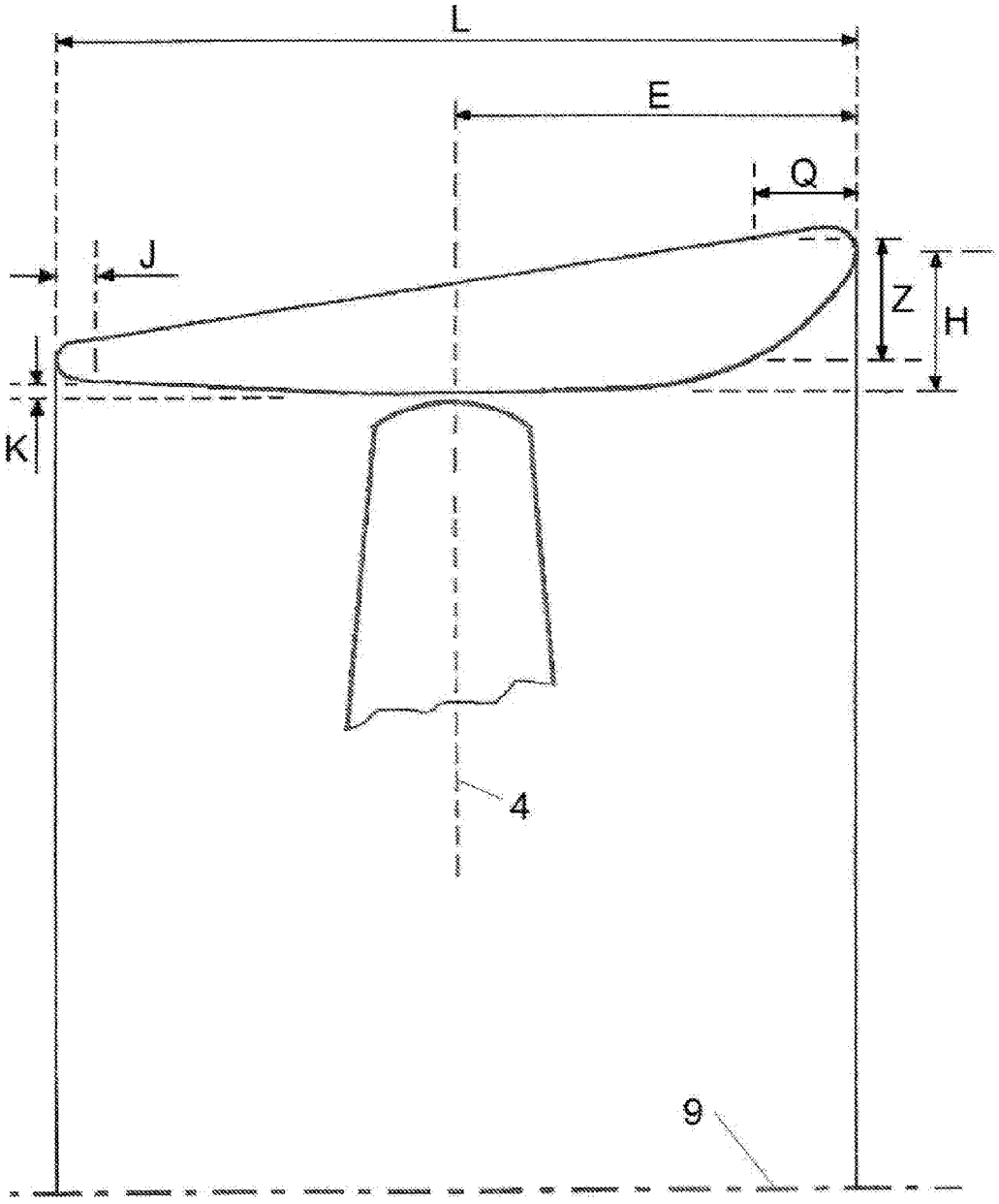
FIG. 7 is a schematic representation of the profile of the 19A nozzle which, as was previously stated, belongs to the state of the art.

In FIG. 7 the same numerical references refer to the same elements as in the preceding figures and the same letter references refer to the same concepts as in the preceding figures; it shows that the 19A nozzle belongs to the state of the art, wherein the axial distance E equals 0.25D; the axial distance Q from the front end 5 of the input edge of the nozzle to an axial distance downstream of 0.066285D; the radial distance Z with a very approximate value of 0.073D, between the inner surface of the nozzle and the outer surface of the nozzle at the aforementioned axial distance Q; the axial length L of the nozzle that equals 0.50D; the radial distance H between the front end of the input edge of the nozzle and the inner radius of the nozzle that equals 0.091D; the inner surface of the nozzle at the axial distance J of 0.025D from the rear end of the output edge of the nozzle is at a radial distance K of 0.0093D from the inner radius of the nozzle, considering the inner radius of the nozzle from the axis of rotation of the propeller. The radial difference between the inner radius of the profile of the nozzle and the outer radius of the profile of the nozzle is 0.210L.

All of these data are calculated based on the published coordinates and using the ratio L/D=0.5, corresponding to the 19A nozzle. The 19A nozzle has a cylindrical inner surface from 0.40L to 0.60L to cover the blade tips of the propeller.

Figure 8:
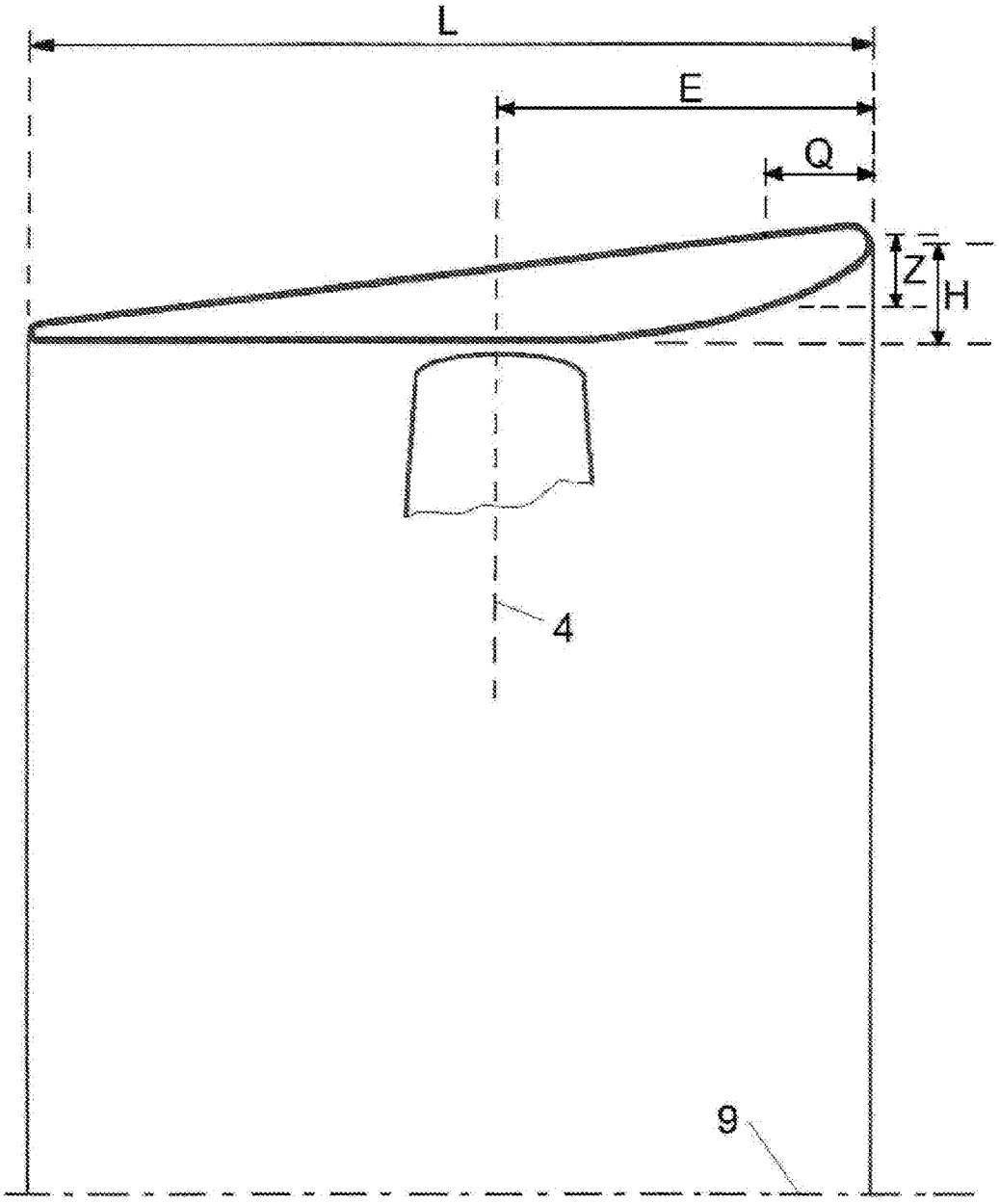
FIG. 8 is a schematic representation of the profile of the nozzle of document ES2460815, belonging to the state of the art.

In FIG. 8, from state of the art document ES2460815, it can be seen that the front end of the input edge of the nozzle is at a radial distance H of 0.053D from the inner radius of the nozzle; the axial length L of the nozzle equals 0.4970D; and the axial distance E equals 0.2281D.

This figure also shows the axial distance Q from the front end of the input edge of the nozzle to an axial distance downstream of 0.066285D; the radial distance Z with a very approximate value of 0.040D, between the inner surface of the nozzle and the outer surface of the nozzle to the aforementioned axial distance Q.

The radial distance between the inner radius of the profile of the nozzle and the outer radius of the profile of the nozzle equals 0.128L, according to the coordinates of document ES2460815.

In fluid mechanics, specific subtle changes lead to highly significant behavioural changes. Specific variations that seem insignificant can produce radical changes in the behaviour of the fluid.

The invention claimed is:

1. An accelerating ducted propeller system for propelling boats, the propeller being configured to rotate inside a nozzle, wherein:

the nozzle is fixed with respect to a vertical plane that contains an axis of rotation of the propeller; according to a general direction of a water flow while the boat is moving forward, a front end of an input edge of the nozzle is at a radial distance from an inner radius of the nozzle comprised between 0.045D and 0.082D, where D is an inner diameter of the nozzle on a propeller plane and considering the inner radius of the nozzle from the axis of rotation of the propeller to an inner surface of the nozzle on the propeller plane; according to the general direction of the water flow while the boat is moving forward, a front end of a chord of an axial profile of the nozzle has a greater radius than a rear end of the chord, with respect to the axis of rotation of the propeller; considering the general direction of the water flow while the boat is moving forward, the inner surface of the nozzle at an axial distance of 0.025D from a rear end of an output edge of the nozzle is at a radial distance from the inner radius of the nozzle that is greater than 0.0040D and less than 0.0300D, considering the inner radius of the nozzle from the axis of rotation of the propeller to the inner surface of the nozzle on the propeller plane; and on a plane that contains the axis of rotation of the propeller, a radial difference between an inner radius of a profile of the nozzle and an outer radius of the profile of the nozzle is less than 0.092D.

2. The accelerating ducted propeller system for propelling boats according to claim 1, wherein the front end of the input edge of the nozzle is at a radial distance from the inner radius of the nozzle comprised between 0.045D and 0.080D; the inner surface of the nozzle at the axial distance of 0.025D from the rear end of the output edge of the nozzle is at a radial distance from the inner radius of the nozzle that is greater than 0.0060D and less than 0.0250D; and the radial distance between the inner radius of the profile of the nozzle and the outer radius of the profile of the nozzle is less than 0.090D.

3. The accelerating ducted propeller system for propelling boats according to claim 2, wherein the front end of the input edge of the nozzle is at a radial distance from the inner radius of the nozzle comprised between 0.045D and 0.075D; the inner surface of the nozzle at the axial distance of 0.025D from the rear end of the output edge of the nozzle is at a radial distance from the inner radius of the nozzle that is greater than 0.0080D and less than 0.0200D; and the radial distance between the inner radius of the profile of the nozzle and the outer radius of the profile of the nozzle is less than 0.088D.

4. The accelerating ducted propeller system for propelling boats according to claim 3, wherein the front end of the input edge of the nozzle is at a radial distance from the inner radius of the nozzle comprised between 0.045D and 0.070D; the inner surface of the nozzle at the axial distance of 0.025D from the rear end of the output edge of the nozzle is at a radial distance from the inner radius of the nozzle that is greater than 0.0100D and less than 0.0175D; and the radial distance between the inner radius of the profile of the nozzle and the outer radius of the profile of the nozzle is less than 0.086D.

5. The accelerating ducted propeller system for propelling boats according to claim 4, wherein the front end of the input edge of the nozzle is at a radial distance from the inner radius of the nozzle comprised between 0.050D and 0.065D; the inner surface of the nozzle at the axial distance of 0.025D from the rear end of the output edge of the nozzle is at a radial distance from the inner radius of the nozzle that is greater than 0.0130D and less than 0.0150D; and the radial distance between the inner radius of the profile of the nozzle and the outer radius of the profile of the nozzle is less than 0.082D.

6. The accelerating ducted propeller system for propelling boats according to claim 1, wherein a radial difference between a centre of a chord of the profile of the nozzle and the outer radius of the profile of the nozzle on the same plane perpendicular to the axis of rotation of the propeller that contains the centre of the chord is less than 0.052L, L being an axial length of the nozzle.

7. The accelerating ducted propeller system for propelling boats according to claim 6, wherein the radial difference between the centre of the chord of the profile of the nozzle and the outer radius of the profile of the nozzle on the same plane perpendicular to the axis of rotation of the propeller that contains the centre of the chord is less than 0.040L, L being the axial length of the nozzle.

8. The accelerating ducted propeller system for propelling boats according to claim 7, wherein the radial difference between the centre of the chord of the profile of the nozzle and the outer radius of the profile of the nozzle on the same plane perpendicular to the axis of rotation of the propeller that contains the centre of the chord is less than 0.030L, L being the axial length of the nozzle.

9. The accelerating ducted propeller system for propelling boats according to claim 1, wherein the nozzle of the system is formed by a single ring-shaped profile.

10. The accelerating ducted propeller system for propelling boats according to claim 1, wherein the propeller has a periphery with the greatest radius of each blade, coaxial to the axis of rotation of the propeller, with a length greater than 0.20R for the coaxial periphery, R being a radius of the blades.

11. The accelerating ducted propeller system for propelling boats according to claim 1, wherein on a plane that contains the axis of rotation of the propeller and according to the general direction of the water flow while the boat is moving forward, a radial distance between the inner surface of the nozzle and an outer surface of the nozzle is greater than 0.043D, at an axial distance of 0.066285D downstream from the front end of the input edge of the nozzle; considering the general direction of the water flow while the boat is moving forward and on a plane that contains the axis of rotation of the propeller, an inner line of the axial profile of the nozzle, at a convergent area, upstream from the propeller, is convex toward the axis of rotation of the propeller in more than 25% of an axial length thereof; and the propeller plane is at a distance greater than 0.38L and less than 0.70L from the front end of the input edge of the nozzle.

12. The accelerating ducted propeller system for propelling boats according to claim 11, wherein the radial distance between the inner surface of the nozzle and the outer surface of the nozzle is greater than 0.044D, at an axial distance of 0.066285D downstream from the front end of the input edge of the nozzle; the inner line of the axial profile of the nozzle, at the convergent area, upstream from the propeller, is convex towards the axis of rotation of the propeller in more than 30% of the axial length thereof; and the propeller plane is at a distance greater than 0.40L and less than 0.65L from the front end of the input edge of the nozzle.

13. The accelerating ducted propeller system for propelling boats according to claim 12, wherein the radial distance between the inner surface of the nozzle and the outer surface of the nozzle is greater than 0.045D, at an axial distance of 0.066285D downstream from the front end of the input edge of the nozzle; the inner line of the axial profile of the nozzle, at the convergent area, upstream from the propeller, is convex towards the axis of rotation of the propeller in more than 60% of the axial length thereof; and the propeller plane is at a distance greater than 0.42L and less than 0.60L from the front end of the input edge of the nozzle.

14. The accelerating ducted propeller system for propelling boats according to claim 13, wherein the radial distance between the inner surface of the nozzle and the outer surface of the nozzle is greater than 0.048D, at an axial distance of 0.066285D downstream from the front end of the input edge of the nozzle; the inner line of the axial profile of the nozzle, at the convergent area, upstream from the propeller, is convex towards the axis of rotation of the propeller in more than 99% of the axial length thereof; and the propeller plane is at a distance greater than 0.44L and less than 0.55L from the front end of the input edge of the nozzle.

15. The accelerating ducted propeller system for propelling boats according to claim 14, wherein the radial distance between the inner surface of the nozzle and the outer surface of the nozzle is greater than 0.051D, at an axial distance of 0.066285D downstream from the front end of the input edge of the nozzle; the inner line of the axial profile of the nozzle, at the convergent area, upstream from the propeller, is convex towards the axis of rotation of the propeller in 100% of the axial length thereof; and the propeller plane is at a distance greater than 0.45L and less than 0.52L from the front end of the input edge of the nozzle.

16. The accelerating ducted propeller system for propelling boats according to claim 1, wherein, considering the general direction of the water flow while the boat is moving forward, more than 80% of the inner surface of the nozzle downstream from the propeller to the output edge is continuously divergent.

17. The accelerating ducted propeller system for propelling boats according to claim 16, wherein the inner surface of the nozzle downstream from the propeller is conical.

18. The accelerating ducted propeller system for propelling boats according to claim 1, wherein on the plane that contains the axis of rotation of the propeller, the radial difference between the inner radius of the profile of the nozzle and the outer radius of the profile of the nozzle is less than 0.184L.

19. The accelerating ducted propeller system for propelling boats according to claim 18, wherein the radial difference between the inner radius of the profile of the nozzle and the outer radius of the profile of the nozzle is less than 0.176L.

20. The accelerating ducted propeller system for propelling boats according to claim 19, wherein the radial difference between the inner radius of the profile of the nozzle and the outer radius of the profile of the nozzle is less than 0.170L.

21. The accelerating ducted propeller system for propelling boats according to claim 20, wherein the radial difference between the inner radius of the profile of the nozzle and the outer radius of the profile of the nozzle is less than 0.148L.

22. The accelerating ducted propeller system for propelling boats according to claim 21, wherein the radial difference between the inner radius of the profile of the nozzle and the outer radius of the profile of the nozzle is less than 0.144L.

23. The accelerating ducted propeller system for propelling boats according to claim 1, wherein, considering the general direction of the water flow while the boat is moving forward, the outer surface of the nozzle, on a margin of the input edge and output edge, has a lower inclination with respect to the axis of rotation of the propeller on a part next to the input edge than on the rest of the output edge.

24. The accelerating ducted propeller system for propelling boats according to claim 23, wherein the outer surface of the nozzle, on the margin of the input edge and output edge, is substantially cylindrical on a front part next to the input edge, with an axial length greater than 0.038L and less than 0.25L.

25. The accelerating ducted propeller system for propelling boats according to claim 24, wherein the outer surface of the nozzle, downstream from the substantially cylindrical surface, is substantially conical to the output edge.

26. The accelerating ducted propeller system for propelling boats according to claim 1, wherein, according to the general direction of the water flow while the boat is moving forward, the output edge of the nozzle is substantially blunt.

27. The accelerating ducted propeller system for propelling boats according to claim 26, wherein the output edge has a substantially toroidal-shaped surface and a radius of curvature of said surface is less than 0.012D.

28. The accelerating ducted propeller system for propelling boats according to claim 1, wherein, considering the general direction of the water flow while the boat is moving forward, a convergent inner surface of a front part of the nozzle is joined to the outer surface of the nozzle by a toroidal-shaped surface, forming the input edge for water in the nozzle; and all or part of the inner surface of the nozzle that surrounds the propeller is cylindrical with the smallest inner radius of the nozzle.

29. The accelerating ducted propeller system for propelling boats according to claim 1, wherein the coordinates of the profile of the nozzle are:

a value of the abscissae is established at 100X/L, taking the values of X from the input edge; 100Yi/L for a value of the inner ordinates; and 100Yu/L for a value of outer ordinates

| 100X/L | 100 Yi/L | 100YU/L |
|---|---|---|
| 0.000 | 10.950 | 10.950 |
| 2.083 | 7.605 | 13.033 |
| 5.807 | 5.377 | 13.033 |
| 9.532 | 3.900 | 13.033 |
| 13.257 | 2.800 | 13.033 |
| 16.981 | 1.977 | 12.900 |
| 20.706 | 1.300 | straight line |
| 24.431 | 0.763 | " |
| 28.155 | 0.370 | " |
| 31.880 | 0.111 | " |
| 36.874 | 0.000 | " |
| 50.000 | 0.000 | " |
| 60.000 | 0.000 | " |
| 70.000 | straight line | " |
| 80.000 | " | " |
| 90.000 | " | " |
| 99.074 | 3.000 | 4.869 |
| 100.000 | 3.926 | 3.926 |

a centre of rotation of a radius of a circumference that creates a toroidal surface of the input edge is established on the abscissa 100X/L=2.083 and ordinate 100Y/L=10.950; a length of the radius has the same value as the abscissa;

a centre of rotation of a radius of a circumference that creates a toroidal surface of the output edge is established on the abscissa 100X/L=99.074 and ordinate 100Y/L=3.926; and an axial length of the nozzle is 0.50D and thus L/D=0.5.

30. The accelerating ducted propeller system for propelling boats according to claim 1, wherein, considering the general direction of the water flow while the boat is moving forward, a front end of the input edge of the nozzle is at a radial distance from the inner radius of the nozzle comprised between 0.055D and 0.080D.

31. The accelerating ducted propeller system for propelling boats according to claim 30, wherein the front end of the input edge of the nozzle is at a radial distance from the inner radius of the nozzle comprised between 0.057D and 0.080D.

32. The accelerating ducted propeller system for propelling boats according to claim 31, wherein the front end of the input edge of the nozzle is at a radial distance from the inner radius of the nozzle comprised between 0.060D and 0.075D.

33. The accelerating ducted propeller system for propelling boats according to claim 32, wherein the front end of the input edge of the nozzle is at a radial distance from the inner radius of the nozzle comprised between 0.065D and 0.075D.

34. The accelerating ducted propeller system for propelling boats according to claim 33, wherein the coordinates of a profile of the nozzle are:

a value of the abscissae is established at 100X/L, taking the values of X from the input edge; 100Yi/L for a value of the inner ordinates; and 100Yu/L for a value of outer ordinates

| 100X/L | 100 Yi/L | 100YU/L |
|---|---|---|
| 0.000 | 14.000 | 14.000 |
| 2.269 | — | 16.269 |
| 4.214 | 8.006 | 16.269 |
| 10.697 | 4.214 | 16.269 |
| 13.197 | — | 16.114 |
| 17.018 | 1.900 | straight line |
| 25.000 | 0.500 | " |
| 36.791 | 0.000 | " |
| 40.000 | 0.000 | " |
| 50.000 | 0.000 | " |
| 56.791 | 0.000 | " |
| 60.000 | straight line | " |
| 70.000 | " | " |
| 80.000 | " | " |
| 90.000 | " | " |
| 99.074 | 3.000 | 4.869 |
| 100.000 | 3.926 | 3.926 |

a centre of rotation of a radius of a circumference that creates a toroidal surface of the input edge is established on the abscissa 100X/L=2.269 and ordinate 100Y/L=14.000; a length of the radius has the same value as the abscissa;

a centre of rotation of a radius of a circumference that creates a toroidal surface of the output edge is established on the abscissa 100X/L=99.074 and ordinate 100Y/L=3.926; and an axial length of the nozzle is 0.50D.

35. The accelerating ducted propeller system for propelling boats according to claim 1, wherein the nozzle is fixed with respect to a hull of the boat.

36. The accelerating ducted propeller system for propelling boats according to claim 1, wherein the nozzle forms part of a directional thruster, also known as azimuth thruster.

37. The accelerating ducted propeller system for propelling boats according to claim 1, wherein it forms part of a boat with a motor that is joined it and provides rotational movement to a propeller shaft.

38. A boat that comprises at least a motor joined to a shaft for producing rotational movement of a propeller with a nozzle, according to claim 1.

39. The boat, which has from two to ten ducted propeller systems, according to claim 38.

* * * * *